US010229798B2

(12) United States Patent
Kulik et al.

(10) Patent No.: US 10,229,798 B2
(45) Date of Patent: Mar. 12, 2019

(54) DEVICE FOR DETECTING MANIPULATION OF AN OBJECT

(71) Applicants: WINCOR NIXDORF INTERNATIONAL GMBH, Paderborn (DE); Michael Nolte, Brakel (DE)

(72) Inventors: Mathias Kulik, Bradenburg (DE); Peter Golueke, Paderborn (DE); Alexander Nentwig, Nuthetal (DE); Michael Nolte, Brakel (DE)

(73) Assignee: Wincor Nixdorf International, GmbH, North Canton ( * ) Notice: Subject to any disclaimer, the term of this patent is extended or adjusted under 35 U.S.C. 154(b) by 0 days.

(21) Appl. No.: 15/510,505

(22) PCT Filed: Aug. 18, 2015

(86) PCT No.: PCT/EP2015/068915
§ 371 (c)(1),
(2) Date: Mar. 10, 2017

(87) PCT Pub. No.: WO2016/037808
PCT Pub. Date: Mar. 17, 2016

(65) Prior Publication Data

US 2017/0256371 A1 Sep. 7, 2017

(30) Foreign Application Priority Data

Sep. 11, 2014 (EP) ..... 14184343

(51) Int. Cl.
*H01H 13/48* (2006.01)
*H01H 13/14* (2006.01)
*H01H 13/22* (2006.01)

(52) U.S. Cl.
CPC ..... *H01H 13/14* (2013.01); *H01H 13/22* (2013.01); *H01H 13/48* (2013.01);
(Continued)

(58) Field of Classification Search
CPC .... H01H 2221/05; H01H 13/14; H01H 13/48; H01H 13/22; H01H 2215/036
See application file for complete search history.

(56) References Cited

U.S. PATENT DOCUMENTS 3,382,338 A * 5/1968 Arseneault ..... H01H 13/702 200/517
4,190,748 A * 2/1980 Langford ..... B41J 5/12 200/5 A (Continued)

FOREIGN PATENT DOCUMENTS

DE 41 39 554 A1 4/1993
DE 102010021696 A1 1/2011
EP 0538199 A2 4/1993

OTHER PUBLICATIONS

English translation of International Search Report and Written Opinion of International Searching Authority for related PCT application.

*Primary Examiner* — Felix O Figueroa
(74) *Attorney, Agent, or Firm* — Black, McCuskey, Souers & Arbaugh, LPA

(57) ABSTRACT

The invention relates to a device (2) for detecting manipulation on an object comprising an actuating switch (22) which has a snap-action disk (220) which can be switched between a first position and a second position, and an actuating element (21) which has a body (210) and an actuating stud (211), projecting from the body of the actuating element (21), for acting on the snap-action disk (220), wherein the actuating stud (211) has a first stiffness. According to the invention a contact element (213), arranged on the actuating stud (211), acts on the snap-action disk (220), wherein the contact element (213) has a second stiffness which is greater than the first stiffness.

13 Claims, 3 Drawing Sheets

(52) U.S. Cl.
CPC . *H01H 2205/034* (2013.01); *H01H 2215/036* (2013.01); *H01H 2221/05* (2013.01); *H01H 2227/03* (2013.01)

(56) References Cited

U.S. PATENT DOCUMENTS

| | | | | | |
|---|---|---|---|---|---|
| 4,352,968 | A * | 10/1982 | Pounds | ..... | H01H 13/7006 200/302.2 |
| 5,280,145 | A * | 1/1994 | Mosier | ..... | H01H 13/7006 200/313 |
| 8,672,705 | B2 * | 3/2014 | Schneider | ..... | H01R 13/5816 439/460 |
| 2010/0320068 | A1 | 12/2010 | Tsai | | |

* cited by examiner

DEVICE FOR DETECTING MANIPULATION OF AN OBJECT

The invention relates to a device for detecting manipulation of an object, in particular of an object having a housing.

Such a device may be, for example, a device for detecting manipulation of a mobile payment terminal. However, the device may also be a device for detecting manipulation of an alarm system, of a smoke detector or of some other object which is to be protected against unauthorized interventions.

Such a device includes an actuating switch and an actuating element which are arranged on an object in such a way that in the event of mechanical manipulation of the object the actuating element acts on the actuating switch and moves it from a first switch position into a second switch position. In such a context, in conjunction with an electrical evaluation device, an electrical signal is generated which can be processed by detection electronics.

For this purpose, the actuating switch has a snap-action disk such as is used, for example, in pushbutton switches in keypads. The snap-action disk has a stable state, which corresponds to a first position, and a meta-stable state, which corresponds to a second position. The actuating element has a body and an actuating stud which projects from the body and has the purpose of acting on the snap-action disk in order to switch it from a first position into a second position in the case of manipulation of the object. By means of an evaluation device, an electrical signal can be generated between the first position and the second position on the basis of the position of the snap-action disk and/or of a switching process of the snap-action disk.

Such an actuating mechanism with an actuating element and an actuating switch with a snap-action disk is known in the technology of pushbutton switches, for example in keypads.

DE 41 39 554 A1 discloses a pushbutton switch in which a push-down knob is formed on a pushbutton cap, said push-down knob acting on a snap-action disk and being preferably of intrinsically elastic design. Manufacturing tolerances can be compensated by means of the push-down knob.

DE 10 2010 021 696 A1 discloses a mechanical keypad in which a switching plunger, which rests on a snap-action disk, is arranged on a silicone mat.

In an electrical pushbutton switch which is known from EP 0 538 199 A2, a pressure knob which switches a snap-action disk is arranged on a pushbutton centering cap.

A technical challenge in devices for detecting manipulation of an object with such an actuating mechanism arises from the fact that fabrication fluctuations during the manufacture and/or the mounting of the actuating element and of the snap-action disk can give rise to an unfavorable switching behavior. If, for example, the tip of the actuating stud is arranged with a slight lateral offset with respect to the center of the snap-action disk, the switching process between the first and the second position of the snap-action disk occurs when there is a triggering force (applied to the actuating element) which differs from the triggering force in the case of an ideally centered arrangement of the actuating stud and snap-action disk.

Fabrication fluctuations in the formation of the actuating stud can likewise lead to undesired fluctuations in the switching behavior of different devices which are nominally of identical design.

Furthermore, when the actuating element is actuated, an angular deviation from an ideal triggering direction (generally perpendicular to the body of the actuating element and at the same time to a body of the actuating switch) can also lead to unfavorably deviating switching behavior or to a malfunction.

A further challenge is presented by the possible occurrence of shocks to the object which are not generated by manipulation of the object but, for example, by the object dropping down or by transport-induced impacts or vibrations. In such cases, the actuating mechanism of the device for detecting manipulation of an object can be triggered, and therefore supposed manipulation can be misdiagnosed.

The object of the present invention is therefore to make available a device for detecting manipulation of an object, which device ensures reliable functioning which is tolerant of faults in respect of fabrication fluctuations and angular deviations during the actuation process.

This object is achieved by means of a device having the features of claim 1. Refinements of the invention are specified in the dependent claims.

Accordingly there is provision to arrange a bearing element for acting on the snap-action disk on the actuating stud which has a first degree of stiffness, wherein the bearing element has a second degree of stiffness which is greater than the first degree of stiffness.

The present invention is based on the experimentally assisted realization that in the configuration of the actuating element the combination of an actuating stud with a first degree of stiffness and a bearing element with a second degree of stiffness which is greater than the first degree of stiffness gives rise to a good switching behavior in respect of the criteria of reliability, fault tolerance and accuracy of the device.

On the one hand the elastic deformability of an actuating stud with a first lower degree of stiffness ensures that when the snap-action disk switches a possible lateral offset, induced by fabrication fluctuations, between the actuating stud and the center of the snap-action disk or a possible angular deviation from an ideal triggering direction during the actuating process can be compensated. In addition, the elastic deformability of the actuating stud with a first, lower degree of stiffness permits the compensation of mass forces which can occur when shocks occur to the object. Therefore, misdiagnosis of supposed manipulation, for example in the case of transport-induced impacts or vibrations can be avoided.

On the other hand, the bearing element with the second degree of stiffness which is greater than the first degree of stiffness during the action on the snap-action disk produces well-defined direct contact with the snap-action disk which can be characterized, in particular, by a small contact area. As a result, the influence of the actuating element (possibly also subject to fabrication-induced fluctuations) on the switching point which is ideally predefined solely by the snap-action disk can be kept as small as possible. Therefore, good reproducibility of the desired switching point is ensured.

In one advantageous refinement, the actuating stud has a rotationally symmetrical basic shape, with the result that it can be easily bent in any direction perpendicular to its main axis in order to compensate angular deviations during the action on the snap-action disk. In this context, it can, for example, be fabricated from silicone so that it is elastically deformable.

The bearing element is preferably fabricated from metal, in particular steel. In this context, it can be of spherical design and can be arranged in a correspondingly shaped receptacle opening on the tip of the actuating stud. In this case, the contact area with the snap-action disk is virtually punctiform.

The snap-action disk preferably has a stable state which corresponds to its first position and a meta-stable state which corresponds to the second position.

In one variant, in a normal position of use of the device for detecting manipulation of an object the bearing element of the device acts on the snap-action disk and holds it in the second, meta-stable position.

In this case, the device is preferably configured to detect manipulation on the basis of the snapping of the snap-action disk into the first position.

The device for detecting manipulation on an object may include, in one advantageous refinement, an evaluation device which is designed to generate an electrical signal between the first position and the second position on the basis of the position of the snap-action disk and/or of a switching process of the snap-action disk. This evaluation device can be, for example, a printed circuit board on which the actuating switch is arranged. The electrical signal corresponds to the detection of manipulation and can be processed in a variety of ways by detection electronics.

In one development, the actuating element can be arranged on one housing part, and the actuating switch can be arranged on another housing part of a housing.

In this context, in a normal position of use of the device which corresponds to a non-manipulated state of the object, the actuating element can act on the snap-action disk and hold the snap-action disk in its meta-stable state. In this case, in the case of manipulation in the form of disassembly of the housing, the actuating element is removed from the snap-action disk and the snap-action disk snaps into the stable state.

However, the first position of the snap-action disk in which it is in its stable state can basically correspond to a normal position of use, i.e. to the non-manipulated state.

The concept on which the invention is based will be explained in more detail below on the basis of the exemplary embodiments illustrated in the figures. In the drawing.

Figure 1:
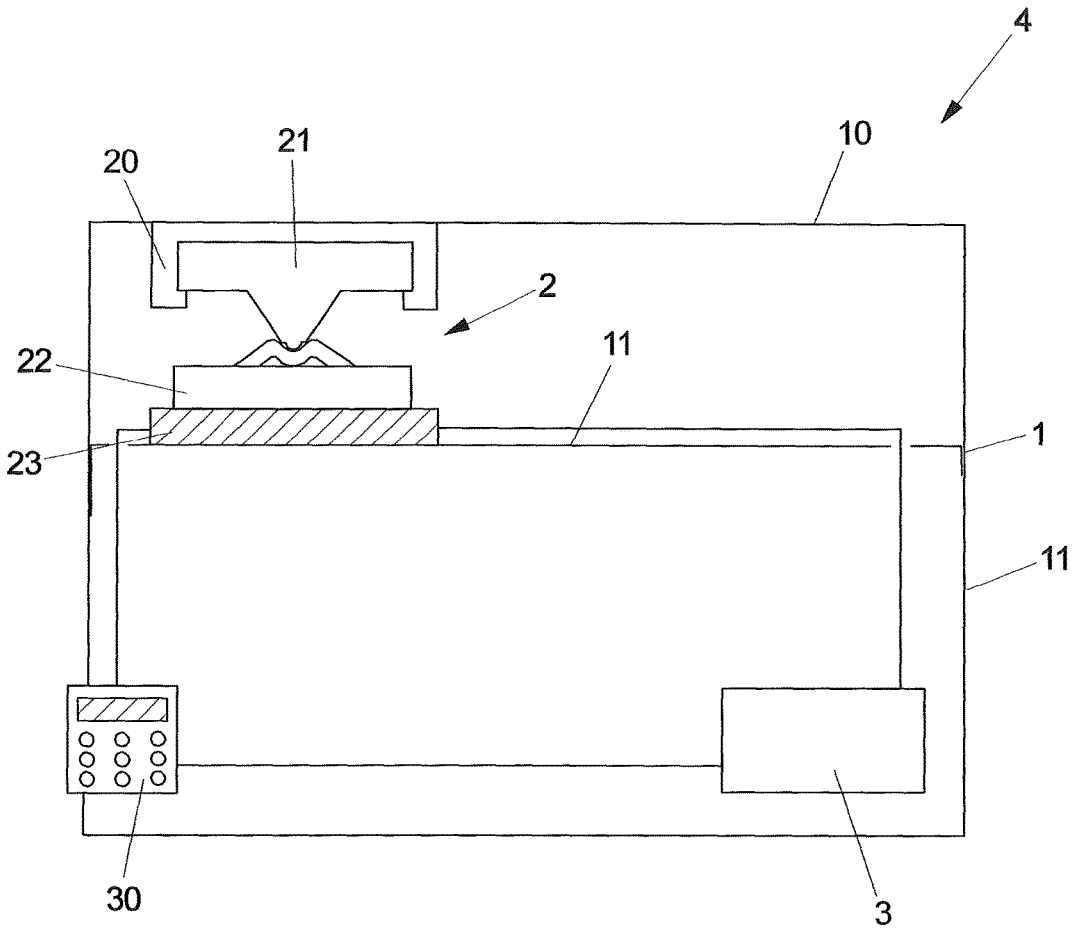
FIG. 1 shows a schematic view of an arrangement for detecting manipulation of an object having a housing.

FIG. 1 shows in a schematic view an arrangement 4 for detecting manipulation of an object having a housing. The object can be, for example, a mobile payment terminal. However, the object can also be, for example, an alarm system, a smoke detector or some other object which is to be protected against unauthorized interventions and has an housing.

The arrangement 4 includes a housing 1 with at least one first housing part 10 and one second housing part 11. The first housing part 10 can be, for example, a disassemblable housing rear wall or a housing cover. The second housing part 11 can accommodate, for example, a sensitive object such as the control and storage electronics of a mobile bank terminal and can enclose the latter together with the first housing part as a housing 1.

An unauthorized person could obtain access to the object enclosed by the housing 1 by disassembling the first housing part 10 from the second housing part 11. In this case, it is desirable to detect disassembly of the first housing part 10 from the second housing part 11.

In order to detect whether the first housing part 10 has been disassembled from the second housing part 11, in the arrangement 4 a device 2 for detecting manipulation of an object is provided which is electrically connected to detection electronics 3 arranged in the second housing part 11, and in the case of disassembly of the first housing part 10 it outputs an electrical signal to the detection electronics 3.

For this purpose, the device 2 for detecting manipulation of an object includes an actuating element 21 which is arranged on a carrier 20, wherein the carrier 20 is arranged together with the actuating element 21 on the first housing part 10, and an actuating switch 22 which is arranged on an evaluation device 23, wherein the evaluation device 23 is arranged together with the actuating switch 22 on the second housing part 11. The evaluation device 23 can be, for example, a printed circuit board.

The actuating element 21 and the actuating switch 22 are arranged opposite one another in such a way that in a normal position of use of the device 2, in which the first housing part 10 is mounted on the second housing part 11, the actuating element 21 acts mechanically on the actuating switch 22 and holds it prestressed in a first switch position. The normal position of use of the device 2 for detecting manipulation of an object is in this context that position which the device 2 is in when the object has not been manipulated.

When the first housing part 10 is disassembled from the second housing part 11, the actuating element 21 is removed from the actuating switch 22, and the actuating switch 22 assumes a second switch position which corresponds to its non-prestressed state. In this context, the evaluation device 23, which can be, for example, a printed circuit board 23 on which the actuating switch 22 is arranged so as to be electrically connected, generates an electrical signal which is passed on to the detection electronics 3. In this context, the detection electronics 3 can also be arranged, for example, directly on the printed circuit board 23.

The electrical signal can be processed in a variety of ways by the detection electronics 3. For example, the result of the occurrence of the electrical signal can be stored for subsequent reading out, with the result that manipulation can be detected in retrospect. Alternatively, the electrical signal can, however, also directly trigger an alarm or, if the object is an electrical or electronic device, deactivate certain functions of this device.

In order to permit authorized disassembly, in the arrangement 4 illustrated in FIG. 1 an external interface 30 is provided with the evaluation device 23 and/or the detection electronics 3, via which, for example by inputting a password with a keypad, the generation of the electrical signal can be deactivated or alternatively the processing of the electrical signal can be changed or prohibited.

Figure 2A:
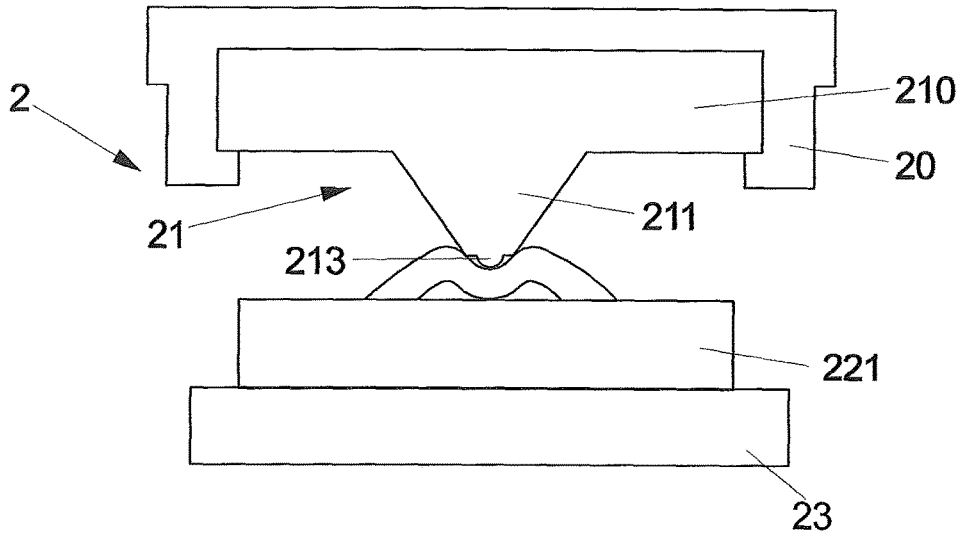
FIG. 2A shows a cross-sectional view through a schematic illustration of a device for detecting manipulation of an object having an actuating switch in a first switch position.
Figure 2B:
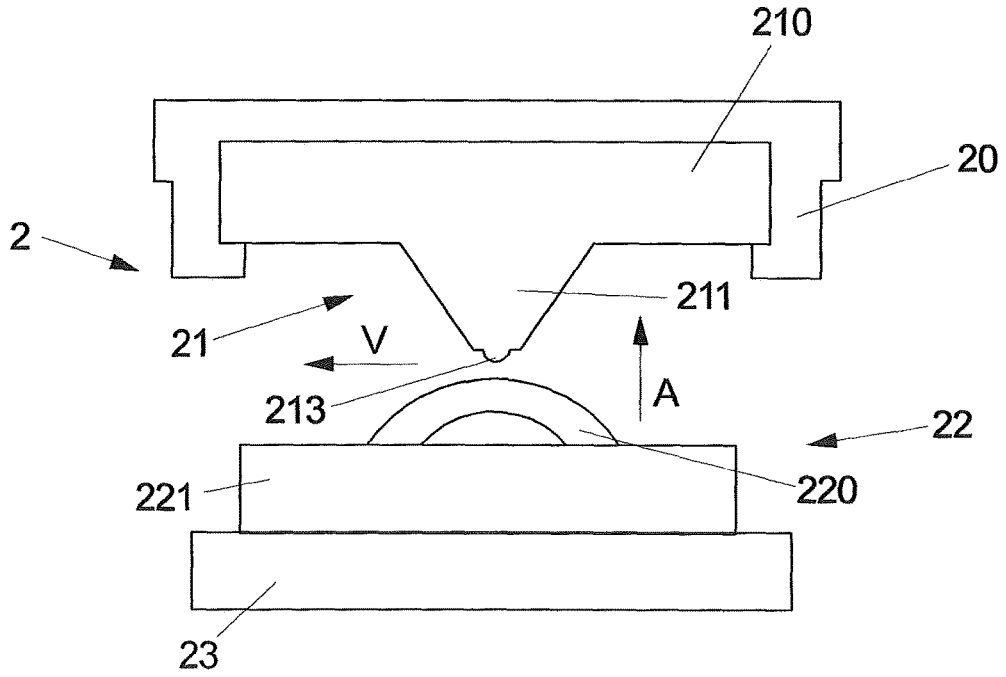
FIG. 2B shows the device in FIG. 2A in a second switch position.

FIG. 2A and FIG. 2B show a device 2 for detecting manipulation of an object In a cross-sectionally schematic view. The actuating switch 22 has a snap-action disk 220. The snap-action disk 220 has a stable state which corresponds to a first position of the snap-action disk 220 which is shown in FIG. 2B, and a meta-stable state which corresponds to a second position of the snap-action disk 220 which is illustrated in FIG. 2A. The actuating element 21 has a body 210 and an actuating stud 211 which projects from the body 210 in the direction of the actuating switch 22 and has the purpose of acting on the snap-action disk 220, In order to switch it from a first position into a second position in the case of manipulation of an object. According to the invention, arranged on the actuating stud 211, which has a first degree of stiffness, is a bearing element 213 for acting on the snap-action disk 220 and has a second, greater degree of stiffness.

An electrical signal can be generated by means of an evaluation device 23 on the basis of the position of the snap-action disk 220 and/or of a switching process of the snap-action disk 220 between the first position and the second position.

FIG. 2A shows the device 2 for detecting manipulation of an object in a position which corresponds to the normal position of use of the device 2 in the arrangement 4 shown in FIG. 1. In this case, the snap-action disk 220 is prestressed in its second, meta-stable position by action of the bearing element 213. However, the position shown in FIG. 2B can basically also correspond to a normal position of use.

Figure 3:
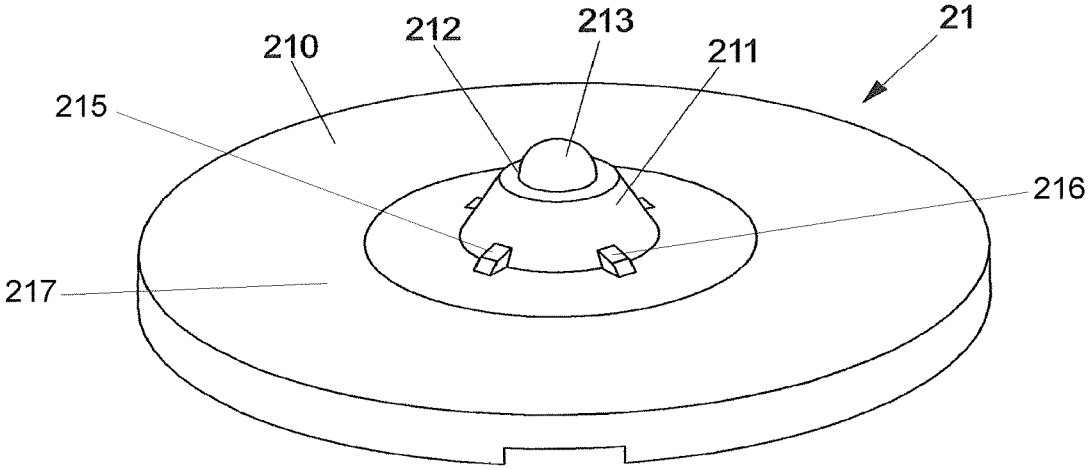
FIG. 3 shows a view of an actuating element which includes a body, an actuating stud and a bearing element.
Figure 4:
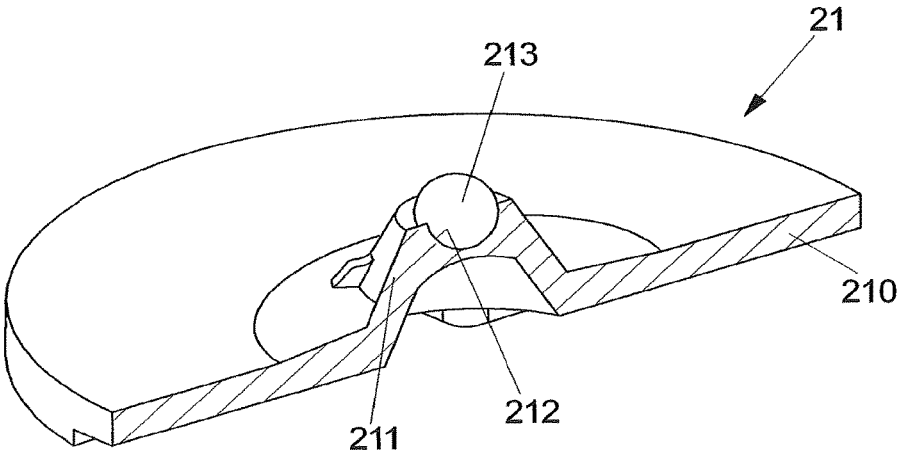
FIG. 4 shows a sectional view through the actuating element shown in FIG. 3.

FIG. 3 shows in relatively large detail the body 210 of the actuating element 21 with the actuating stud 211 and the bearing element 213 in an embodiment in which the actuating stud 211 has a rotationally symmetrical basic shape, specifically conical basic shape. The bearing element 213 in this advantageous refinement is of spherical design and, as can be clearly seen in the sectional view in FIG. 4, is arranged in a receptacle opening 212 which is correspondingly formed in an approximately hemispherical shape. As shown in FIG. 4, the actuating stud 211 is conically-shaped and hollow. FIGS. 3 and 4 also show that a plurality of reinforcing ribs, such as referenced at 215 and 216, extend between the outer, conical surface of the actuating stud 211 and a flat surface 217 of the body 210 and are spaced from one another.

The difference according to the invention between the degree of stiffness of the actuating stud 211 and that of the bearing element 213 is implemented in one advantageous embodiment by virtue of the fact that the actuating stud 211 is fabricated from silicone, and the bearing element 213 is a steel ball.

The advantages of such a refinement of a device 2 for detecting manipulation of an object are explained below.

When an arrangement 4 is mounted according to FIG. 1, a certain degree of lateral offset can occur within the scope of unavoidable fabrication fluctuations when the actuating element 21 is fastened to the first housing part 10 and/or the actuating switch 22 is fastened to the second housing part 11. For example, the printed circuit board 23 with the actuating switch 22 or the actuating switch 22 can be considered to be shifted a little in the direction marked by V in FIG. 2B on the circuit board 23. In such a case, the tip of the actuating stud 211 and the center of the snap-action disk 220 are not centered one above the other and the force of the actuating element 21 does not act on the snap-action disk 220 precisely perpendicularly with respect to its curved surface.

This can entail the problem that the snapping over of the disk at the transitions between the stable position and the meta-stable position of the disk takes place when there are snap-over forces which are different from those predefined and which correspond to an ideally centered relative arrangement of actuating switch 22 and actuating element 21. In order to keep this effect small, it is advantageous to fabricate the actuating stud 211 from an elastic material such as silicone so that in the case of non-centered action on the snap-action disk 220 it can correspondingly bend and therefore the force component acting perpendicularly on the curved surface of the snap-action disk 220 becomes as large as possible.

A spherical bearing element 213 composed of a non-elastic material which is more rigid than the actuating stud 211, such as e.g. steel, acts here in a supporting fashion in the sense of reducing the variation of the snap-over forces, since even when the action on the curved surface of the snap-action disk 220 is not ideally perpendicular, a constantly small contact surface, which is even approximately punctiform in the case of the sphere, is ensured. Therefore, possible fluctuating influences on the snap-over forces which depend on properties of the bearing element 213 are suppressed.

An elastic actuating stud 211 has the further advantage that, to a certain degree, spring absorption of shocks (due, for example, to transportation) to the housing can occur, with the result that said shocks do not cause the snap-action disk 220 to snap over, and therefore do not bring about a misdiagnosis in terms of supposed manipulation.

On the other hand, the relatively stiff bearing element prevents an excessively pronounced hysteresis during the switching between the two switch positions of the actuating switch 22 which result from long creeping processes. This would in turn entail an undesirably large influence of properties (possibly subject to fabrication fluctuations or variable environmental influences) of the actuating element 21 on the switching point which is to be set as far as possible solely by means of the snap-action disk 220.

LIST OF REFERENCE SYMBOLS

1 Housing
10 First housing part
11 Second housing part
2 Device for detecting manipulation of an object
20 Carrier
21 Actuating element
210 Body of the actuating element
211 Actuating stud
212 Receptacle opening
213 Bearing element
210 Actuating switch
220 Snap-action disk
221 Body of the actuating switch
23 Evaluation device (printed circuit board)
3 Detection electronics
30 External interface
4 Arrangement for detecting manipulation of an object with a housing
A Triggering direction
V Offset direction

The invention claimed is:

1. A device for detecting manipulation of an object, having:

an actuating switch which has a snap-action disk which can be switched between a first position and a second position;

an actuating element which has a body and an actuating stud which projects from the body of the actuating element, wherein the actuating stud has a first degree of stiffness;

a bearing element which is arranged on the actuating stud for acting on the snap-action disk, wherein the bearing element has a second degree of stiffness which is greater than the first degree of stiffness;

wherein the actuating stud is conically-shaped and hollow; and wherein the bearing element is arranged in a receptacle opening which is formed on the actuating stud, the receptacle opening formed in a hemispherical shape.

2. The device as claimed in claim 1, wherein the actuating element is manufactured from silicone.

3. The device as claimed in claim 1, wherein the actuating element has a rotationally symmetrical basic shape.

4. The device as claimed in claim 1, wherein the bearing element is spherical.

5. The device as claimed in claim 1, wherein the bearing element is fabricated from metal.

6. The device as claimed in claim 5, wherein the bearing element is fabricated from steel.

7. The device as claimed in claim 1, wherein the snap-action disk has a stable state which corresponds to the first position and a meta-stable state which corresponds to the second position.

8. The device as claimed in claim 1, wherein in a normal position of use of the device the bearing element acts on the snap-action disk and holds the snap-action disk in the second position.

9. The device as claimed in claim 1, wherein manipulation can be detected on the basis of the snapping of the snap-action disk into the first position.

10. The device as claimed in claim 1, further comprising:

an evaluation device which is designed to generate an electrical signal on the basis of the position of the snap-action disk and/or of a switching process of the snap-action disk between the first position and the second position.

11. An arrangement having:

a housing having a first housing part and a second housing part; and a device as claimed in claim 1, wherein the actuating element of the device is arranged on the first housing part of the housing, and the actuating switch is arranged on the second housing part of the housing.

12. The device as claimed in claim 1, further comprising:

at least one reinforcing rib extending between an outer, conical surface of the actuating stud and a flat surface of the body.

13. The device as claimed in claim 12, wherein the at least one reinforcing rib is further defined as a plurality of reinforcing ribs spaced from one another.

* * * * *